United States Patent [19]

Testart

[11] Patent Number: 5,042,755

[45] Date of Patent: Aug. 27, 1991

[54] PROCESS FOR PRODUCING A CROSSING FROG WITH A MOVING POINT

[75] Inventor: Gérard Testart, Andresy, France

[73] Assignee: Cogifer (Cie Generale D'Installations Ferroviaires), Rueil Malmaison, France

[21] Appl. No.: 421,197

[22] Filed: Oct. 13, 1989

[30] Foreign Application Priority Data

| | | | |
|---|---|---|---|
| Oct. 14, 1988 | [FR] | France | 88 13723 |
| Dec. 12, 1988 | [FR] | France | 88 16515 |
| Dec. 12, 1988 | [FR] | France | 88 16516 |

[51] Int. Cl.[5] ..... E01B 7/04; E01B 7/14

[52] U.S. Cl. ..... 246/385; 246/462; 29/446

[58] Field of Search ..... 246/375, 380, 381, 382, 246/385, 386, 392, 454, 460, 461, 468, 471, 472, 462; 238/165; 29/446, 469, 525.1, DIG. 38

[56] References Cited

U.S. PATENT DOCUMENTS

| | | | |
|---|---|---|---|
| 72,077 | 12/1867 | Perkins | 29/525.1 |
| 569,653 | 10/1896 | McCann | 246/385 |
| 736,911 | 8/1903 | Aley | 246/385 |
| 859,101 | 7/1907 | Odenkirk et al. | 246/385 |
| 1,273,983 | 7/1918 | Alonzo | 246/382 |
| 1,784,211 | 12/1930 | Vissat | 246/382 |
| 3,910,534 | 10/1975 | Perrot | 246/382 X |
| 4,514,235 | 4/1985 | Augustin et al. | 246/471 X |
| 4,589,617 | 5/1986 | Kempa | 246/468 X |
| 4,637,578 | 1/1987 | Frank | 246/392 X |
| 4,953,814 | 9/1990 | Oswald et al. | 246/382 |

FOREIGN PATENT DOCUMENTS

| | | | |
|---|---|---|---|
| 2244902 | 4/1973 | Fed. Rep. of Germany | 246/382 |
| 1224889 | 3/1971 | United Kingdom . | |

OTHER PUBLICATIONS

*Zeitschrift Fur Eisenbahnwesen Und Verkehrstechnik Glasers Annalen,* vol. 103, No. 11, Nov. 1979, pp. 387-397.

*Primary Examiner*—Frank E. Werner
*Assistant Examiner*—Scott L. Lowe
*Attorney, Agent, or Firm*—Young & Thompson

[57] ABSTRACT

A process for producing a crossing frog with moving point (1) for very long railway switches incorporated in long welded rails. The frog also comprises a cradle (2) in two elements (3 and 4), one molded and the other not molded. The element (3) is of molded steel, of which at least the two ends (3A and 3B) on the point side and the two ends (3C and 3D) on the heel side are shaped as a rail profile, but only the rail profile of the two ends (3A and 3B) effectively serves for rolling. The non-molded element (4) is mainly made up of parts (5 and 5') produced integrally as rails and connected to the two ends (3C and 3D) on the heel side of the molded part (3). Neither the rail profile of the two ends (3C and 3D) nor the rail profile of the parts (5 and 5') effectively serves as rolling surface. The moving point (1) is produced integrally as rails of which all the upper faces effectively serve as rolling surface.

7 Claims, 3 Drawing Sheets

PROCESS FOR PRODUCING A CROSSING FROG WITH A MOVING POINT

The present invention relates to a crossing frog with a moving point for very long railway switches incorporated in long welded rails, said crossing frog also comprising, in particular, a cradle in two elements, and to a process for producing such a crossing frog.

BACKGROUND OF THE INVENTION

It is known that the increase in speed on railway tracks, which can now be as high as 270 km/h and will soon be 300 km/h, or even higher, has led to the creation of very long switches to allow very high speeds at deviations, of the order of 170 km/h to 220 km/h and even higher.

In these very long switches, the crossings are also very long and, at these speeds, it is known that it is preferable to use crossing frogs with a moving point, which are more comfortable than crossing frogs with a fixed point, in which the counter-rails cause return movements of the vehicle axles, which are difficult to tolerate.

Indeed, crossing frogs with a moving point have been constructed for many years, but current designs are not completely satisfactory Crossing frogs with a moving point generally comprise two fundamental elements:

the cradle in which the moving point is fixed at the heel and in which it moves when maneuvered;

the moving point itself.

The cradle is necessarily composed of several elements because their respective length is limited by the current state of production methods. It is therefore necessary, for producing the desired construction, to manufacture several elements, then to join them to form the cradle. As it is impossible, for constructional reasons associated, in particular, with a lack of space, to produce this joint by conventional fish-plating which would hold the elements of the cradle at the interior and the exterior, C-shaped members placed at the exterior of the cradle elements are used to form the joint. Now such a joint does not have the qualities of fish-plating and, even less, the qualities of a weld and, however much care is taken when producing and joining these C-shaped parts, this joint will necessarily exhibit problems in strength in the long term.

Furthermore, the moving point, produced from machined and joined rails, is secured at its heel in one of the cradle elements in the manner of a bracket embedded in a wall.

Its flexibility therefore enables it to rest against one of the point elements of the cradle in the position at the right or at the left when it is maneuvered by appropriate devices.

As these switches are incorporated in long welded rails, that is to say are connected to framing rails without expansion device, the fixing of the moving point has to ensure - apart from the role of embedding the bracket - that the compressive or tensile stresses of each long welded rail are transferred from the moving point onto the cradle.

In the conventional manner, such stresses are transferred by fish-plates stuck to the rail and to the frog.

Now when a molded embedding cradle element is used, the adhesion of the parts allowing the point to be secured in the cradle can obviously be produced on the moving point side where there is a rail form but cannot be produced on the cradle side as it has the form of a rigid box.

It is therefore necessary, to ensure that the stresses are transferred, to use a mechanical joint which has to be produced with high precision to reduce the clearances and to comply with the constraints for incorporation into long welded rails.

With current constructions, there are two mechanical adjustments which are difficult to make, are liable to deteriorate during service and thus have a detrimental effect on the service life of the product.

SUMMARY OF THE INVENTION

The general problem to be solved by the subject of the present invention is therefore to design and produce a crossing frog having a moving point in which the disadvantages associated with these two mechanical assemblies are overcome.

For this purpose, the present invention relates to a crossing frog having a moving point for very long railway switches incorporated in long welded rails, said crossing frog also comprising, in particular, a cradle in two elements, one molded and the other not molded, the crossing frog being characterized in that the molded element is of steel and comprises at least the two ends on the point side and the two ends on the heel side shaped into a rail profile, but only the rail profile of the two ends on the point side effectively serving for rolling, the non-molded element being made up mainly of parts produced integrally as rails and connected to the two ends on the heel side of the molded part, but neither the rail profile at the two heel-side ends nor the rail profile of the parts effectively serving as rolling surface, the moving point, for its part, being produced integrally as rails of which all the upper faces effectively serve as rolling surface.

BRIEF DESCRIPTION OF THE DRAWINGS

The invention will be understood better by means of the following description which relates to a preferred embodiment which is given as a non-limiting example and is explained with reference to the accompanying schematic drawings, in which.

DETAILED DESCRIPTION OF THE PREFERRED EMBODIMENT

Figure 1:
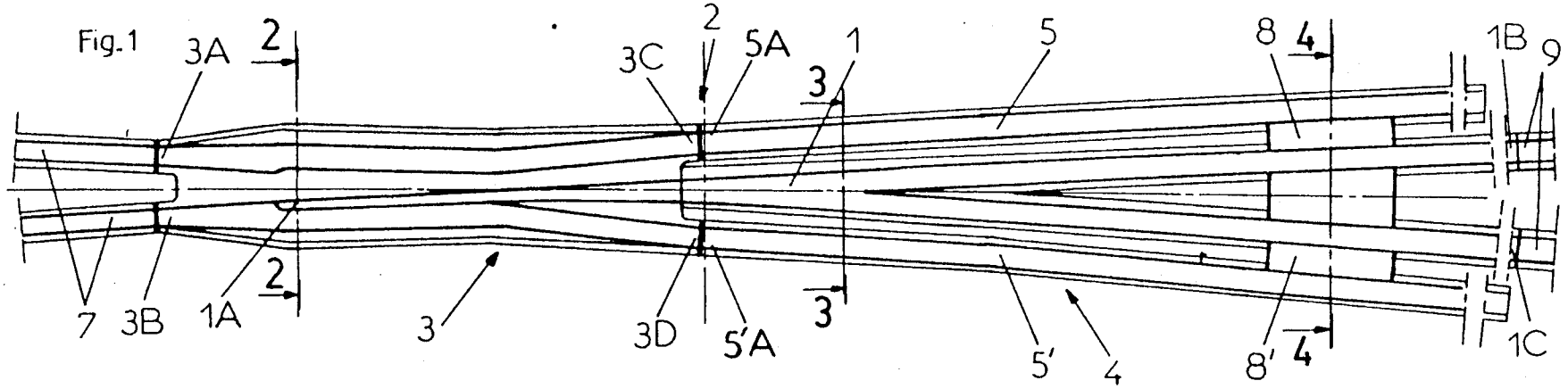
FIG. 1 is a plan view of a crossing frog having a moving point, according to the invention, said point being located on the right.
Figure 5:
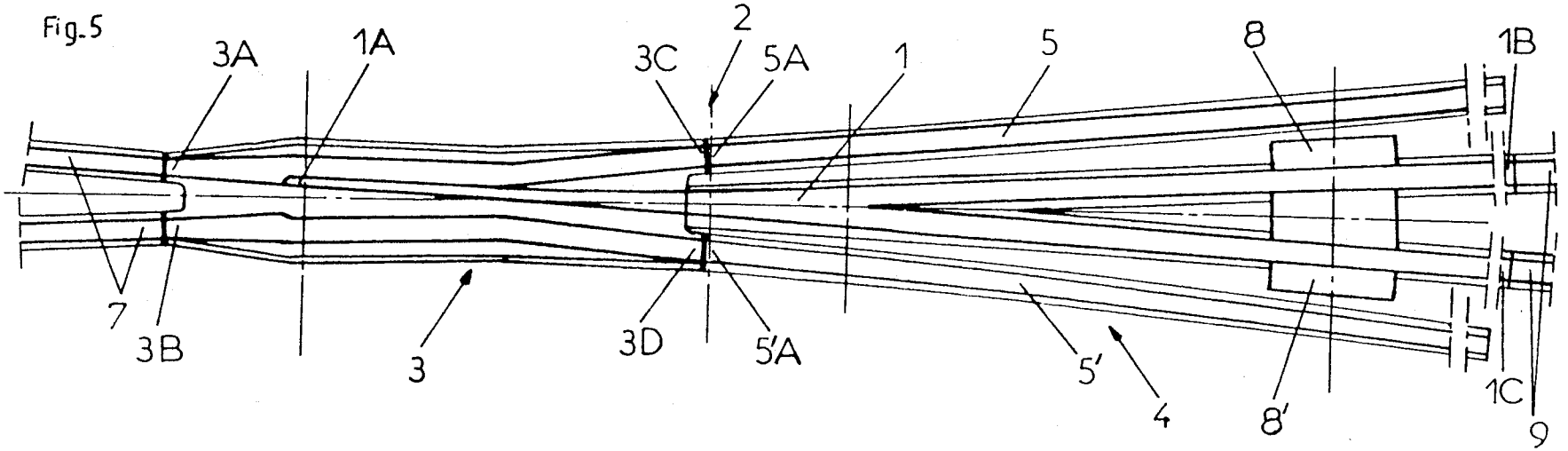
FIG. 5 is a plan view of the crossing frog shown in FIG. 1, the point being located on the left and in which the two parts belonging to the non-molded element and produced in rails are in the spread position.

According to the invention and as shown in FIGS. 1 and 5 of the accompanying drawings, the crossing frog with a moving point 1 for very long railway switches incorporated in long welded rails also comprises, in particular, a cradle 2 in two elements 3 and 4, one molded and the other not molded. Element 3 is of molded steel, of which at least the two ends 3A and 3B on the point side and the two ends 3C and 3D on the heel side are shaped as a rail profile. However, only the rail profile of the two ends 3A and 3B effectively serves for rolling, the non-molded element 4 being mainly made up of parts 5 and 5' produced integrally as rails and connected to the two ends 3C and 3D on the heel side of the molded part 3. Neither the rail profile of the two ends 3C and 3D nor the rail profile of the parts 5 and 5' effectively serves as rolling surface, the moving point 1, for its part, being produced integrally as rails of which all the upper faces effectively serve as rolling surface.

According to the invention, the non-molded element 4 is made up mainly of parts 5 and 5' produced integrally as rails and connected by welding or by non-welded assembly at the two ends 3C and 3D on the heel side of the molded element 3 (see FIGS. 1 and 5 of the accompanying drawings).

According to a characteristic of the invention, the molded element 3 advantageously has all its upper faces shaped as a rolling track.

It should be noted that a process is known for assembling, by arc welding, crossing frogs produced from hard manganese-containing austenitic steel and rails produced from carbon steel by connecting them end to end by means of an intermediate part produced from austenitic steel having a low carbon content.

Therefore, according to a preferred characteristic of the invention, the molded element 3 is of manganese-containing austenitic steel, the moving point 1 and the parts 5 and 5' being made up of carbon steel rails.

The arc welding of the ends 3A and 3B of the molded element 3 to the rolling rails 7 of the intermediate track of the branch can thus be carried out by this known process. An intermediate part produced from austenitic steel will therefore be inserted between the ends 3A and 3B of the molded element 3 and the rolling rails 7.

Figure 4:
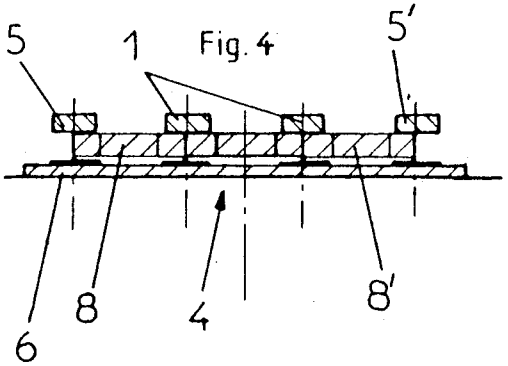
FIG. 4 is a front view in section along the line 4—4 in FIG. 1.

According to a further characteristic of the invention and as shown in FIGS. 1 and 4 of the accompanying drawings, there are two rail profile parts 5 and 5' which are connected by adhesion to the rails forming the moving point 1 by means of two cross members 8 and 8' having the profile of a fishplate.

Consequently, the embedding at the heel of the moving point 1 produced by the cross members 8 and 8' adhered, on the one hand, to the rails constituting the moving point 1 and, on the other hand, to the parts 5 and 5' of the non-molded element 4 avoids the use of a mechanical joint and thus eliminates all the disadvantages associated with the use of such a joint, in particular the longitudinal clearances.

Figure 3:
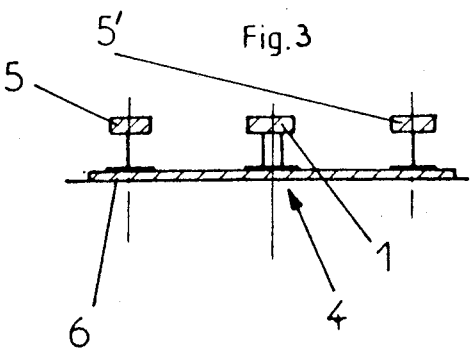
FIG. 3 is a front view in section along the line 3—3 in FIG. 1.
Figure 2:
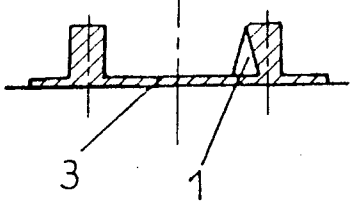
FIG. 2 is a front view in section along the line 2—2 in FIG. 1.

As shown in FIGS. 2 to 4 of the accompanying drawings, the parts 5 and 5' are attached to one another and the non-molded element 4 is rigidified by means of plates 6.

The non-molded element 4, made up of parts 5 and 5' fixed to the ends 3C and 3D of the molded element 3 and rigidly connected by plates 6 therefore forms, with said molded element 3, a cradle 2 of which the length is no longer limited by the casting constraints.

According to a further characteristic of the invention, the rails of parts 5 and 5' and of the moving point can advantageously have a height, for example, of 172 mm.

Furthermore, according to a first variation, each part 5 and 5' as well as the moving point 1 can advantageously be formed, for example, by a rail of profile UIC A 74. With regard to the moving point 1, such a switch rail allows significant vertical inertia to be imparted to it.

However, according to a second variation, each part 5 or 5' can advantageously be formed, for example, from a rail of profile UIC 60, and the moving point 1 from a switch rail of profile UIC A 74, also allowing significant vertical inertia to be imparted to it.

The present invention also relates to a process for producing a crossing frog having a moving point 1.

According to the invention and according to a first embodiment, the process for producing a crossing frog having a moving point essentially involves welding, on the point side, the molded element 3 of the cradle 2 to the rolling rails 7 of the intermediate track of the branch and fixing on the molded element 3 of the cradle 2 parts 5 and 5' belonging to the non-molded element 4 of the cradle 2, then spreading said parts 5 and 5' from their starting position toward the exterior and holding them in the spread position, inserting the moving point 1 between these parts 5 and 5', releasing the parts 5 and 5' so that they return to their starting position, then fixing the parts 5 and 5' to the moving point inserted between them, rigidifying the non-molded element 4 and, finally, welding, if necessary, the moving point 1 to the rolling rails 9 on the heel side.

The production process takes place mainly in the following manner.

The molded element 3 of the cradle 2 is firstly welded, on the point side, to the rolling rails 7 of the intermediate track of the branch, and the two parts 5 and 5', produced as rails, are each welded at one 5A, 5'A of its two ends to one of the two ends 3C and 3D, on the heel side, also of rail profile, of the molded element 3. Each part 5 and 5' is formed by a rail, precisely to allow it to be welded to the two ends 3C and 3D, also of rail profile.

The molded element 3 with its two parts 5 and 5' and its two welded rolling rails 7 is then placed on an assembly table.

As shown in FIG. 5 of the accompanying drawings, the parts 5 and 5' are spread outward from their starting position, the parts 5 and 5' being flexible from the zone where they are welded to the molded element 3.

The parts 5 and 5' are then held in the spread position (see FIG. 5) and the moving point 1 is lowered and inserted in the cradle 2 formed by the elements 3 and 4, between the two parts 5 and 5' in the spread position. The moving point 1 is produced from welded and joined rails and has previously been provided with two embedding cross members 8 and 8' which are preferably fixed there by adhesion. The two parts 5 and 5' are then released so that they can be fixed to the cross members 8 and 8' of the moving point, preferably by adhered fish-plating.

Plates 6 are then fixed beneath the non-molded element 4 so as to connect the parts 5 and 5' and thus to rigidify the non-molded element 4.

Finally, the crossing frog produced in this way is lowered from the assembly table again.

The two ends 1B and 1C of the moving point 1 remote from the pointed end 1A itself and shaped as a rolling track could subsequently, or possibly prior to assembly in situ, be welded to the rolling rails 9.

In situ, such a crossing frog could then be fixed to the sleepers and connected to the rails of the railway.

According to a further characteristic of the invention, the welding, on the one hand, of the two ends 3A and 3B of the molded element 3 to the rolling rails 7 of the intermediate track of the branch and, on the other hand, of the two ends 5A, 5'A of the two parts 5 and 5' to the two ends 3C and 3D of the molded element 3 is of the electric arc type.

As mentioned above, on the one hand, the ends 5A and 5'A of the parts 5 and 5' could be arc welded to the ends 3C and 3D of the molded element 3 and, on the other hand, the ends 3A and 3B of the molded element 3 to the rolling rails 7 of the intermediate track of the branch, by the known process. An intermediate part produced from austenitic steel would therefore be inserted, on the one hand, between the ends 5A and 5'A of the parts 5 and 5' and the ends 3C and 3D of the molded element 3 and, on the other hand, between the ends 3A and 3B of the molded element 3 and the rolling rails 7.

However, it is also known that the connection between two rails by welding has the main advantage of eliminating the presence of a joint, as this joint would impair the strength of the railway due to the impact of the wheels on the rolling surfaces of the rails. Now in the crossing frog forming the subject of the present invention, the two parts 5 and 5' belonging to the non-molded element 4 of the cradle 2 and produced integrally as rails do not serve as a rolling surface. Under these conditions, the connection between these two parts 5 and 5' and the molded element 3 of the cradle 2 can also be produced by a non-welded joint, but without having the disadvantage described above.

Consequently, according to a variation of the process for producing the crossing frog having a moving point 1, the parts 5 and 5' belonging to the non-molded element 4 of the cradle 2 are connected to the molded element 3 of the cradle 2 by a non-welded joint.

According to a second embodiment, in the production process according to the invention, the operations involving fixing parts 5 and 5' belonging to the non-molded element 4 of the cradle 2 to the molded element 3 of the cradle 2, then spreading said parts 5 and 5' outward from their starting position and holding them in the spread position, inserting the moving point 1 between these parts 5 and 5', releasing the parts 5 and 5' so that they return to their starting position, then fixing the parts 5 and 5' to the moving point inserted between them and rigidifying the non-molded element 4 are replaced by the following operations:

fixing of the parts 5 and 5' to the moving point 1 so as to form the non-molded element 4 of the cradle 2;

rigidification of said non-molded element 4;

inter-connection, by means of a non-welded joint, of the two sub-assemblies thus formed, that is to say the one formed by the molded element 3 welded to the rolling rails 7 and the one formed by the non-molded element 4, itself formed by the parts 5 and 5' and the moving point 1.

Consequently, the rolling rails 7 of the intermediate track of the branch are firstly welded, on the point side, to the ends 3A and 3B of the molded element 3 of the cradle 2. Welding is advantageously electric arc welding.

The moving point 1 is then placed on an assembly table and two embedding cross members 8 and 8' are fixed, preferably by adhesion, on the moving point 1 produced from machined and joined rails. The parts 5 and 5' are then fixed to the cross members 8 and 8' of the moving point 1, preferably by adhered fish-plates (the cross members 8 and 8' are formed by fish-plate profiles joined by welded bars; the fish-plate profiles are adhered, on the moving point side, to said point 1 and, on the non-molded element 4 side, to the parts 5 and 5', and are then bolted).

Plates 6 are then fixed beneath the non-molded element 4 so as to inter-connect the parts 5 and 5' and thus to rigidify the non-molded element 4.

The non-molded element 4 produced in this way is lowered from the assembly table.

The first sub-assembly, formed by the molded element 3 welded to the rolling rails 7, is then placed on an assembly table. The second sub-assembly, formed by the non-molded element 4, itself formed by the parts 5 and 5' and the moving point 1, is brought toward the first sub-assembly at this stage by vertical, then longitudinal transfer or longitudinal then vertical transfer so as to place the molded element 3 of the cradle 2 end to end with the parts 5 and 5' of the non-molded element 4 of the cradle 2.

The two rail profile ends 3C and 3D on the heel side of the molded element 3 are then connected to the two respective ends 5A and 5'A of the two parts 5 produced as rails.

This joint, inter-connecting the two sub-assemblies, will be in the form of a bolted joint, preferably an adhered fish-plate. This, as well as everything that follows, could also be valid in the variation of the first embodiment corresponding to the non-welded connection of the parts 5 and 5' to the molded element 3.

Figure 6:
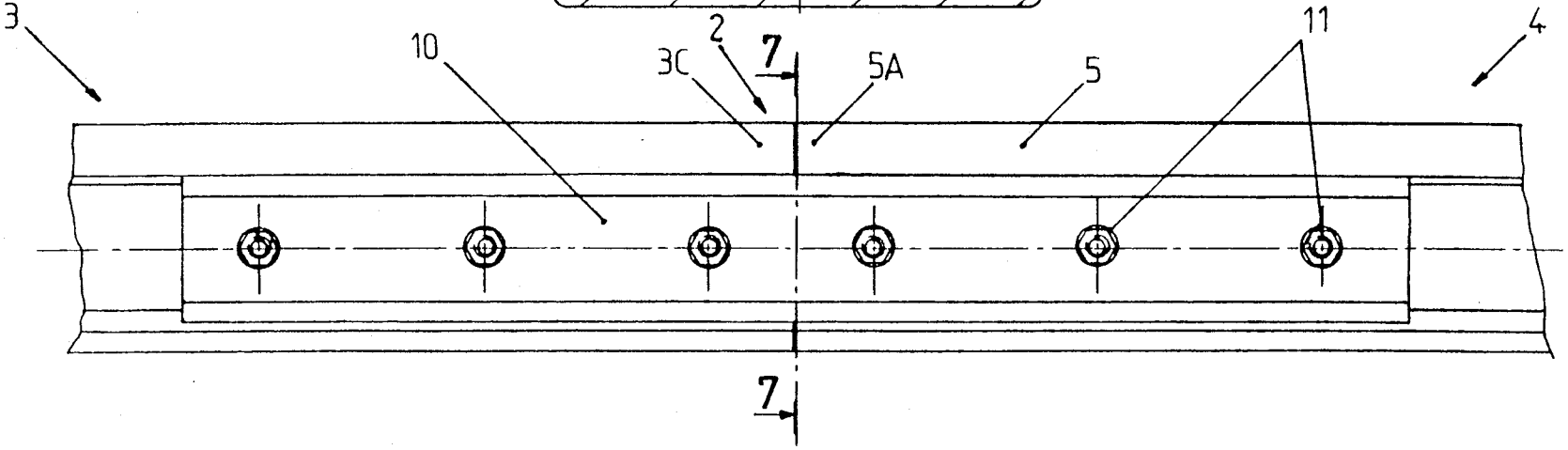
FIG. 6 is a front view, on an enlarged scale, of a method of connecting the molded element to a part produced as a rail profile, belonging to the non-molded element.

The end 5A or 5'A of the parts 5 or 5' is consequently connected to the respective end 3C or 3D of the molded element 3 by two fish-plates 10 joined by six bolts 11, three bolts 11 on the molded element 3 side and three bolts 11 on the part 5 side (see FIG. 6 of the accompanying drawings).

These fish-plates 10 (four in total) will be stuck in the fish-plating chambers by means of a glue constituted by a resin and a hardener which each form half of the composition of the glue. This may advantageously be the glue "KLEBER E26-05 METALON" produced by the company HENKEL. The KLEBER resin as well as the KLEBER hardener are thoroughly mixed prior to adhesion.

Figure 7:
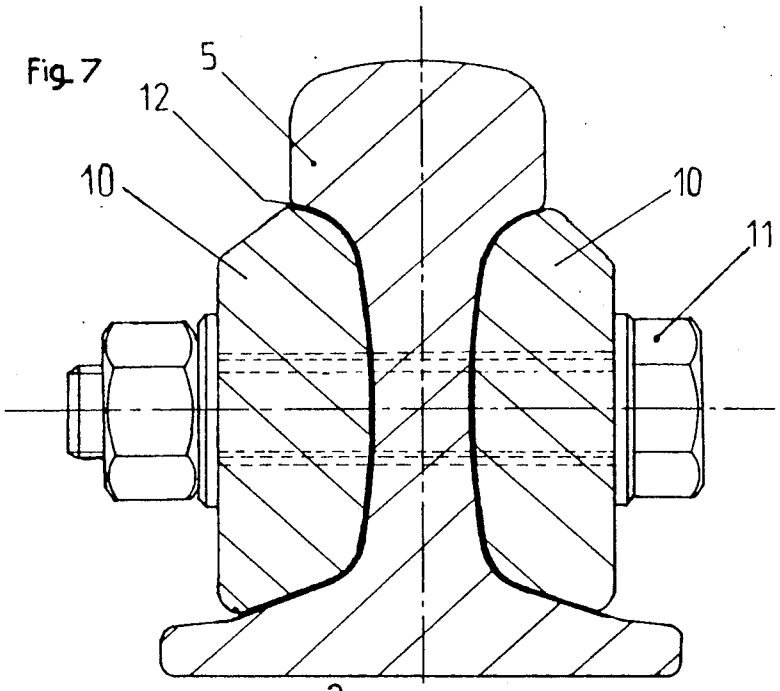
FIG. 7 is a front view in section on an enlarged scale along the line 7—7 in FIG. 6.

According to a further characteristic of the invention and as shown in FIG. 7 of the accompanying drawings, a glass fibre cloth 12 is inserted between each fish-plate 10 and, on the one hand, the ends 5A, 5'A of the parts 5 and 5' and, on the other hand, the ends 3C and 3D of the molded element 3.

The fish-plates 10 will preferably be sufficiently long for the adhesion surface, obtained from the KLEBER glue and the glass fibre cloth 12, to allow the tensile and compressive stresses caused by the variations in temperature to be transferred into the long welded rails.

Finally, the crossing frog produced in this way is lowered from the assembly table again.

The two ends 1B and 1C of the moving point 1 remote from the pointed end 1A itself and shaped as a rolling track can be welded subsequently or possibly prior to in situ assembly to the rolling rails 9.

In situ, such a crossing frog could thus be fixed to the sleepers and connected to the rails of the railway.

Obviously the invention is not limited to the embodiments described and illustrated in the accompanying drawings. Modifications are possible, in particular with regard to the constitution of the various elements or by substitution of equivalent methods, but without departing from the scope of protection of the invention.

What is claimed is:

1. A method for producing a crossing frog with a moving point (1), for very long railway switches incorporated in long welded rolling rails (7 and 9), said crossing frog comprising, a cradle (2) in two elements (3 and 4), one molded and the other not molded, the method comprising welding, on a point side of said frog, the molded element (3) of the cradle (2) to the rolling rails (7) of an intermediate track of a branch, attaching to the molded element (3) of the cradle (2) rail means (5 and 5') connected to the non-molded element (4) of the cradle (2), spreading said rail means (5 and 5') outward from an initial unstressed position and holding said rail means in a spread position, inserting the moving point (1) between said rail means (5 and 5'), releasing said rail means (5 and 5') so that said rail means return to the initial unstressed position, attaching said rail means (5 and 5') to the moving point inserted between the rail means, rigidifying the non-molded element (4) and finally, welding the moving point (1) to the rolling rails (9) on a heel side of said frog.

2. Production process according to claim 1, comprising carrying out the following operations in succession:

welding, on the point side, the two ends (3A and 3B) of the molded element (3), shaped as a rail profile, to the rolling rails (7) of the intermediate track of the branch, and welding two parts (5 and 5') produced as rails, each at one of its two ends (5A and 5A') to one of the two ends (3C and 3D) on the heel side, also as a rail profile, of the molded element (3);

placing the molded element (3) with its two parts (5 and 5') and its two welded rolling rails (7) on an assembly table;

spreading the parts (5 and 5') outward from their starting position, the parts (5 and 5') being flexible from the zone where they are welded to the molded element (3);

holding the parts (5 and 5') in the spread position;

positioning the moving point (1), produced from machined and joined rails and previously provided with two embedding cross members (8 and 8') by insertion between the two parts (5 and 5') in the spread position;

releasing the two parts (5 and 5');

fixing the parts (5 and 5') to the cross members (8 and 8') of the moving point (1);

fixing plates (6) beneath the non-molded element (4) so as to connect the parts (5 and 5') and thus to rigidify the non-molded element (4);

lowering the crossing frog produced in this way from the assembly table;

welding the two ends (1B and 1C) of the moving point (1) remote from the pointed end (1A) itself and shaped as a rolling track to the rolling rails (9).

3. A production process according to claim 2 wherein the welding, on the one hand, of the two ends (3A and 3B) of the molded element (3) to the rolling rails (7) of the intermediate track of the branch and, on the other hand, of the two ends (5A and 5'A) of the two parts (5 and 5') to the two ends (3C and 3D) of the molded element (3) is of the electric arc type.

4. A production process according to claim 2, wherein the embedding cross members (8 and 8') are previously fixed to the moving point (1) by adhesion.

5. A production process according to claim 2, wherein the parts (5 and 5') are fixed to the cross members (8 and 8') by adhered fish-plating.

6. A production process according to claim 1, wherein the parts (5 and 5') belonging to the non-molded element (4) of the cradle (2) are connected to the molded element (3) of the cradle (2) by a non-welded joint.

7. A production process according to claim 6, wherein the parts (5 and 5') produced from rails are connected by a bolted joint, each at one (5A, 5'A) of its two ends to one of the two ends (3C and 3D) on the heel side, also as a rail profile, of the molded element (3).

* * * * *